US007327186B1

(12) United States Patent
Wadhwa et al.

(10) Patent No.: US 7,327,186 B1
(45) Date of Patent: Feb. 5, 2008

(54) FAST WIDE OUTPUT RANGE CMOS VOLTAGE REFERENCE

(75) Inventors: Sameer Wadhwa, Santa Clara, CA (US); Bhimachar Venkatesh, Cupertino, CA (US)

(73) Assignee: Spansion LLC, Sunnyvale, CA (US)

( * ) Notice: Subject to any disclaimer, the term of this patent is extended or adjusted under 35 U.S.C. 154(b) by 38 days.

(21) Appl. No.: 11/135,925

(22) Filed: May 24, 2005

(51) Int. Cl.
*G05F 1/10* (2006.01)
*G05F 3/02* (2006.01)

(52) U.S. Cl. ..... 327/541; 327/538

(58) Field of Classification Search ..... 327/538–541, 327/57, 66; 323/311–316
See application file for complete search history.

(56) References Cited

U.S. PATENT DOCUMENTS 4,965,510 A * 10/1990 Kriedt et al. ..... 323/315
5,087,891 A * 2/1992 Cytera ..... 330/288
5,818,212 A * 10/1998 Min et al. ..... 323/314
6,054,879 A 4/2000 Meng
6,307,791 B1 * 10/2001 Otsuka et al. ..... 365/189.05
6,392,392 B1 * 5/2002 Nakahara ..... 323/312
6,448,821 B1 * 9/2002 Sakurai ..... 327/56
6,510,082 B1 1/2003 Le et al.
6,529,412 B1 3/2003 Chen et al.
6,624,671 B2 * 9/2003 Fotouhi ..... 327/112
6,657,473 B1 * 12/2003 Eto ..... 327/261
6,791,880 B1 9/2004 Kurihara et al.
6,819,591 B1 11/2004 Kurihara et al.

OTHER PUBLICATIONS

"Virtual-Ground Sensing Techniques for Fast, Low-Power, 1.8V Two-Bit-Per-Cell Flash Memories", Binh Quang Le, A Dissertation Submitted to the Department of Electrical Engineering and the Committee on graduate studies of Stanford University in partial fulfillment of the requirements for the degree of Doctor of Philosophy, Nov. 2003, 148 pgs.

* cited by examiner

*Primary Examiner*—Dinh T. Le
(74) *Attorney, Agent, or Firm*—Eschweiler & Associates, LLC

(57) ABSTRACT

A circuit is disclosed that compensates for changes in temperature as well as for fluctuations in a supply voltage (Vcc) so that voltage reference values generated thereby are maintained at substantially constant levels irrespective of changes in temperature or fluctuations in supply voltage. The circuit is also configured to produce a wide range of voltage reference values so that it can independently service the needs of many different applications. Additionally, the circuit is designed using meal oxide semiconductor (MOS) technology, as opposed to more conventional bipolar technology, so that it "settles down" or generates reference values relatively quickly.

8 Claims, 3 Drawing Sheets

FAST WIDE OUTPUT RANGE CMOS VOLTAGE REFERENCE

FIELD OF INVENTION

The present invention relates generally to voltage generation circuitry, and more particularly to a circuit for generating a voltage reference.

BACKGROUND OF THE INVENTION

It can be appreciated that there are many different applications where a voltage reference is useful. For example, a voltage reference can be used to determine the state or status of a memory cell. In particular, the voltage reference allows the cell to be "read" by comparing the value of the voltage reference (which corresponds to a known state of the memory cell) to an amount of charge stored within the cell. Essentially, if the amount of charge stored within the cell is above the voltage reference value, then the cell can be said to be at a first state, whereas if the amount of charge stored within the cell is below the voltage reference value, then the cell can be said to be at a different second state, where the first and second states of the memory cell corresponds to respective bits of data stored within the cell.

It can also be appreciated that it would be desirable for such reference voltage values to be stable so that they do not fluctuate under different operating conditions. For example, where a voltage reference is used to read a memory cell in a cellular telephone, for example, and the telephone goes from residing in a user's pants pocket (and thus being very warm) to the open air (and thus being relatively cool), it would be desirable for the value of that voltage reference to remain relatively constant regardless of the changes in temperature. In this manner, the state of a memory cell could be accurately determined irrespective of changes in temperature.

In addition to being insensitive to changes in temperature, it would also be desirable for voltage reference values to be insensitive to fluctuations in a supply voltage (Vcc) used to generate the voltage references. In this manner, the state of a memory cell, for example, could again be accurately determined regardless of changes in the supply voltage (e.g., due to low battery power and/or power surges).

Further, since voltage references have many different applications, such as for reading many different types and/or sizes of memory cells that operate on or store substantially different charge levels, for example, it can be appreciated that it would also be useful for a circuit that generates such reference voltages to have a wide output range so that a single circuit could provide many different voltage reference values needed to accommodate many different applications.

Finally, it would be desirable for such a circuit to operate very fast to satisfy the ongoing demand for electronic devices that can quickly perform a large number of increasingly complex functions. However, conventional circuits are very slow—mostly because they use bipolar technology. More particularly, conventional circuits which are used to generate voltage references are bandgap circuits which use bipolar junction transistors and their bandgap potential to generate the reference values. However, using bandgap reference values to generate voltage reference values requires a relatively long time to settle down from a power down stage (e.g., on the order of hundreds of nanoseconds or microseconds). When reading from a memory cell or doing a random access operation on a memory, for example, a delay of hundreds of nanoseconds or microseconds is an unacceptable or impractical amount of time to have to wait for the voltage reference to settle down before sensing the memory.

Accordingly, a circuit would be desirable that could provide a wide range of voltage reference values that are substantially insensitive to changes in temperature or supply voltage (Vcc) so that the values are maintained at substantially constant levels irrespective of changes in temperature or supply voltage. It would also be desirable for the circuit to "settle down" or generate the voltage reference values quickly.

SUMMARY OF THE INVENTION

The following presents a simplified summary of the invention in order to provide a basic understanding of some aspects of the invention. This summary is not an extensive overview of the invention. It is intended neither to identify key or critical elements of the invention nor to delineate the scope of the invention. Rather, its primary purpose is merely to present one or more concepts of the invention in a simplified form as a prelude to the more detailed description that is presented later.

One or more aspects of the present invention pertain to a circuit that compensates for changes in temperature as well as for fluctuations in a supply voltage (Vcc) so that voltage reference values generated thereby are maintained at substantially constant levels irrespective of changes in temperature or fluctuations in supply voltage. The circuit is also configured to produce a wide range of voltage reference values so that it can independently service the needs of many different applications. Additionally, the circuit is designed using meal oxide semiconductor (MOS) technology, as opposed to more conventional bipolar technology, and it uses a fast op-amp based feedback stage. Thus, it "settles down" or generates reference values relatively quickly.

According to one or more aspects of the present invention, a circuit is disclosed for generating a voltage reference. The circuit basically includes first, second and third stages. The first stage comprises a first resistor operatively coupled to a supply voltage Vcc, and a first transistor operatively coupled to the first resistor and to ground. The second stage includes an operational amplifier, a positive input terminal of which receives a first voltage V1 from the first stage. The second stage also has a second transistor that is driven by the operational amplifier. A second resistor is also included in the second stage, where a first end of the second resistor is operatively coupled to the second transistor and back to a negative input terminal of the operational amplifier. A second end of the second resistor is coupled to ground. A third transistor is also part of the second stage, where the third transistor is operatively coupled to the second transistor and to the supply voltage. A second voltage V2 is developed at the first end of the second resistor. The third stage of the circuit includes a fourth transistor operatively coupled to the third transistor of the second stage so as to establish a current mirror arrangement such that a third current I3 developed in the third stage is a function of a second current I2 developed in the second stage. The third stage also has a fifth transistor operatively coupled to the fourth transistor and to ground. The fifth transistor outputs one or more voltage reference values that are a function of the third current I3.

To the accomplishment of the foregoing and related ends, the following description and annexed drawings set forth in detail certain illustrative aspects and implementations of the invention. These are indicative of but a few of the various ways in which one or more aspects of the present invention may be employed. Other aspects, advantages and novel features of the invention will become apparent from the following detailed description of the invention when considered in conjunction with the annexed drawings.

DETAILED DESCRIPTION OF THE INVENTION

Figure 1:
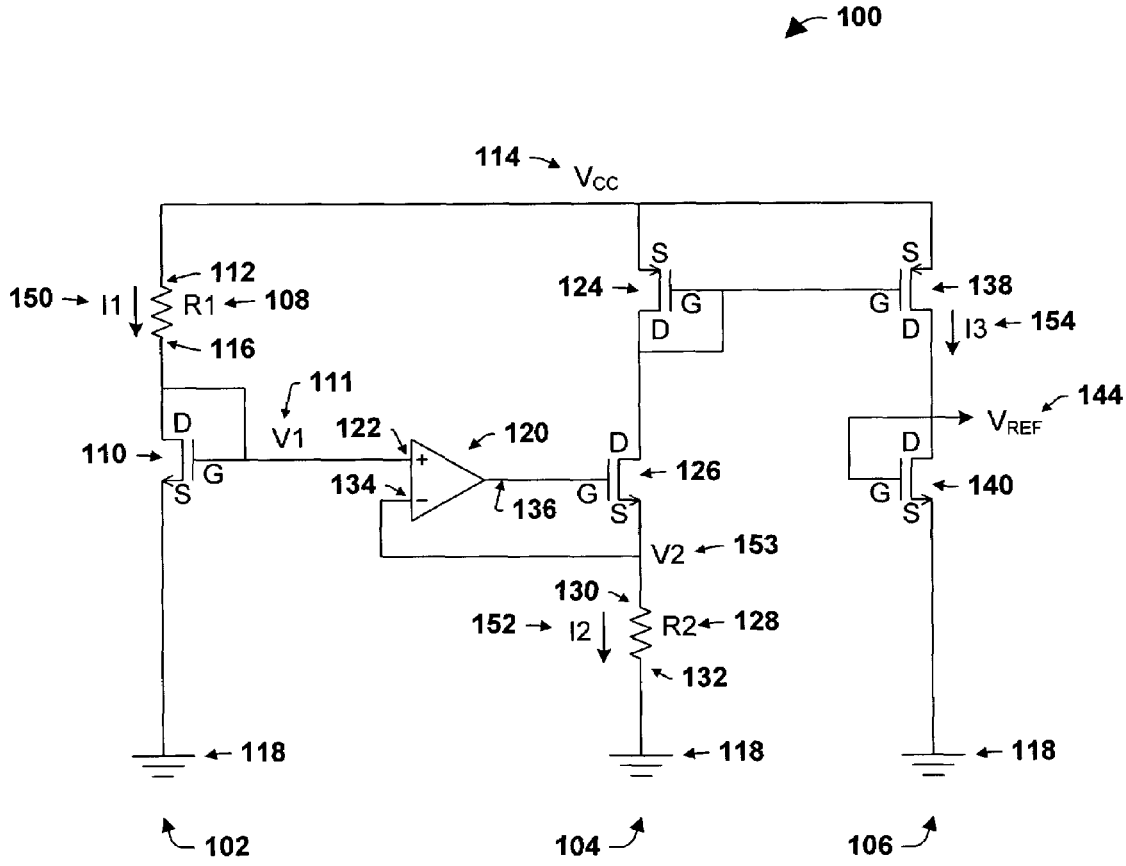
FIG. 1 is a schematic diagram illustrating an exemplary circuit arrangement according to one or more aspects of the present invention for quickly generating a wide range of temperature and Vcc insensitive voltage reference values.

One or more aspects of the present invention are described with reference to the drawings, wherein like reference numerals are generally utilized to refer to like elements throughout, and wherein the various structures are not necessarily drawn to scale. In the following description, for purposes of explanation, numerous specific details are set forth in order to provide a thorough understanding of one or more aspects of the present invention. It may be evident, however, to one skilled in the art that one or more aspects of the present invention may be practiced with a lesser degree of these specific details. In other instances, well-known structures and devices are shown in block diagram or other form in order to facilitate describing one or more aspects of the present invention.

Turning to FIG. 1, a circuit schematic is presented that illustrates an exemplary circuit arrangement 100 according to one or more aspects of the present invention for quickly generating a wide range of temperature and supply voltage (Vcc) insensitive voltage reference values. The circuit 100 basically has three stages 102, 104, 106. The first stage 102 comprises a first resistor R1 108 and a first diode connected n type or NMOS transistor device 110. A first end 112 of the first resistor R1 108 is coupled to a supply voltage (Vcc) 114, and the other or second end 116 of the first resistor R1 108 is coupled to the drain (D) of the n device 110, while the source (S) of the n device 110 is coupled to ground 118. The first stage 102 outputs a first voltage V1 111 at the gate (G) of then device 110.

The second stage 104 comprises an operational amplifier or op amp 120, the positive terminal 122 of which is operatively coupled to the gate (G) of the first n device 110 (e.g., the output of the first stage 102) so as to receive V1 as an input to this terminal 122. The second stage 104 also comprises a second diode connected p type or PMOS transistor device 124, a second n type device 126 and a second resistor R2 128. The source (S) of the p device 124 is coupled to the supply voltage Vcc 114, and the drain (D) of the p device 124 is coupled to the drain (D) of the n device 126. The source (S) of the n device 126 is coupled to a first end 130 of resistor R2 128, while the second end 132 of resistor R2 128 is coupled to ground 118. The operational amplifier 120 is connected in a feedback configuration in that the negative terminal 134 of the op amp 120 is coupled to the first end 130 of the resistor 128, while the output 136 of the op amp 120 is coupled to the gate (G) of the n device 126.

The third stage 106 comprises a third p type transistor device 138, the source (S) of which is coupled to the supply voltage 114 and the drain of which is coupled to the drain (D) of a third n type device 140. The source (S) of the n type device 140 is coupled to ground 118, while the gate (G) of the device 140 outputs a reference voltage (Vref) 144, which is the voltage reference generated by the circuit 100. The gate (G) of p device 138 is operatively coupled to the gate (G) of p device 124 so that these devices 138, 124 function as a current mirror.

It can be appreciated that a first current I1 150 flows through the first stage 102 when the circuit 100 is activated, and that sensitivity to changes in the supply voltage Vcc 114 cab be mitigated by tuning the first resistor 108 and the first transistor 110 so that the first voltage V1 111 is kept close to the threshold voltage (Vt) of the first n device 110. This can be seen from the following equations.

$$I1 = \frac{Vcc - V1}{R1}$$

$$I1 = K\left(\frac{W}{L}\right)(Vgs - V1)^2 = K\left(\frac{W}{L}\right)(V1 - Vt)^2,$$

where K is a constant, W refers to a width aspect of the first n type device 110, L refers to a length aspect of the first n type device 110 and Vgs refers to the gate to source voltage of the first n type device 110.

$$\Rightarrow \frac{Vcc - V1}{R1} = K\left(\frac{W}{L}\right)(V1 - Vt)^2$$

$$Vcc - V1 = KR1\left(\frac{W}{L}\right)(V1^2 + Vt^2 = 2V1Vt)$$

$$\Rightarrow V1^2\left(KR1\left(\frac{W}{L}\right)\right) + V1\left(1 - 2KR1Vt\left(\frac{W}{L}\right)\right) + Vt^2\left(KR1\frac{W}{L}\right) - Vcc = 0$$

$$\text{Let } KR1\frac{W}{L} = a$$

$$\Rightarrow aV1^2 + V1(1 - 2aVt) + aVt^2 - Vcc = 0$$

$$\Rightarrow V1 = \frac{2aVt - 1}{2a} \pm \sqrt{\frac{(2aVt - 1)^2 - 4a(aVt^2 - Vcc)}{4a^2}}$$

$$V1 = Vt - \frac{1}{2a} \pm \sqrt{\frac{(2aVt - 1)^2 - 4a(aVt^2 - Vcc)}{4a^2}}$$

However, V1≧Vt for the n type device 110 to be on $$\Rightarrow V1 = Vt - \frac{1}{2a} + \sqrt{\left(Vt - \frac{1}{2a}\right)^2 - \left(Vt^2 - \frac{Vcc}{a}\right)}$$

Maximize a to reduce dependence on Vcc

For a very large a (e.g., a→∞)

⇒V1≈Vt, which is independent of Vcc.

In this manner the voltage V1 111 from the first stage 102 is substantially independent of Vcc where it is close to the Vt of the n device 110. It is, however, important to note that V1 is designed to be sufficiently larger than Vt to mitigate operation of the device within a weak-inversion region. This mitigates device in-stability with regard to process variations.

As in the first stage 102, it can be appreciated that a second current I2 152 runs through the second stage 104 when the circuit 100 is activated. Moreover, the current I2 152 is a function of the voltage V1 111 and thus exhibits insensitivity to changes in the supply voltage Vcc 114. More particularly, the op amp 120 is connected in a feedback configuration to drive the second n device 126 to generate a second voltage V2 153 at the first end of the second resistor R2 128 that is substantially equal to the first voltage V1 111. In this manner, the current I2 152 flowing through resistor R2 128 is equal to V1 111 divided by R2 128. Since V1 111 is independent of Vcc, I2 152 is likewise substantially independent of Vcc 114.

The third stage 106 similarly has a third current I3 154 running there-through when the circuit 100 is activated. The current mirror arrangement between the third p type device 138 and the second p type device 124 sets the third current I3 154 equal to the second current I2 152 times a constant K, where K corresponds to a ratio of aspects of the second device 124 to the third device 138. The value of K can be readily adjusted by varying the ratio of the p devices 124, 138 to one another. Since I2 152 is insensitive to changes in the supply voltage Vcc 114, I3 154 is likewise independent of Vcc 114. It can thus be appreciated that since the current I3 flowing through the device 140 (which is operated in saturation) is already independent of Vcc 114, that Vref 144 doesn't have to be close to the threshold voltage (Vt) of the n device 140 to maintain that Vcc independence. As such, the Vref 144 can swing from about the lowest threshold voltage (Vt) in the circuit 100 to about Vcc 114. This allows the circuit 100 to output a wide range of voltage reference values. Such values can, for example, be adjusted by altering the ratio K between the current mirror devices 124, 138 or by varying the resistor R2. Furthermore, the n device 140 operates in its saturation region. The relationship between I3 and Vref can be expressed by the following equations.

$$I3=K\times(W/L)\times(Vref-Vt)^2$$

$$\Rightarrow \text{Vref}\propto\sqrt{\text{I3}}$$

$$\Rightarrow \text{Vref}\propto\sqrt{\text{VI}}$$

Thus, the third stage 106 provides further independence from changes in Vcc 114 while concurrently extending the design range for Vref 144.

It can be appreciated that some of the elements of the circuit 100 may have some temperature sensitivity, such as the resistor R1 108 in the first stage 102, the threshold voltage Vt of the n device 110 in the first stage 102, the resistor R2 128 in the second stage 104 and the threshold voltage Vt of the n device 124 in the third stage 106, for example. The resistors R1 108 and R2 128 can have either a positive or negative temperature coefficient, for example, depending on what kind of resistors are being used in the circuit 100. Similarly, the respective Vt's of the diode connected devices 110 and 124 can have a negative temperature coefficient such that the Vt's decrease as the temperature increases.

According to one or more aspects of the present invention, however, the circuit 100 can be tuned to mitigate temperature sensitivity so that the output Vref 144 is substantially insensitive to changes in temperature. In particular, the resistor R1 108, the n device 110, the resistor R2 128 and the n device 124 can be chosen to mitigate temperature sensitivity. In the first stage 102, for example, R1 108 can be chosen to have a negative coefficient to cancel out the negative temperature coefficient of the Vt of the n device 110 in stage one 102 so that V1 111 output by the first stage 102 is substantially temperature independent. By way of example, where V1 is close to Vt, the n device 110 can be modeled as a resistor Rn1 (not shown) that has a negative temperature coefficient. If both resistors R1 and Rn11 increase or decrease from a change in temperature, V1 remains substantially unchanged since R1 and Rn1 form a voltage divider, i.e., V1=Rn1/(R1+Rn1). In this manner, the value of V1 111 will remain substantially constant regardless of variations in temperature.

In the third stage 106, the final output device 140 can also have a negative temperature coefficient, meaning that if the temperature increases, Vref 144 will tend to decrease. To compensate for this temperature sensitivity, the current I3 154 can be increased as a function of increasing temperature to correspondingly increase Vref 144. The current I3 154 in the third stage 106 can be increased by reducing R2 128 as the temperature increases. The resistor R2 128 can be decreased as a function of increasing temperature by using a negative temperature coefficient resistor for R2 128, such as a polysilicon resistor, for example, which compensates for the negative temperature coefficient of the output n device 140.

It will be appreciated that the speed of the circuit 100 is primarily a function of the second stage 104, and in particular, the functioning of the op amp 120 therein. More particularly, since the first 102 and third 106 stages don't perform feedback operations, they settle relatively quickly (e.g., within one to two nanoseconds of applying Vcc 114). The speed of the circuit 100, thus depends primarily on how fast the operational amplifier 120, and in particular the unity gain frequency thereof, can regulate V2 153 substantially equal to V1 111. The unity gain frequency of the op amp 120 can be tuned, however, so that it, and thus the entire circuit 100, settles within a period of about four to about nine nanoseconds, for example, of applying Vcc 114.

Figure 2:
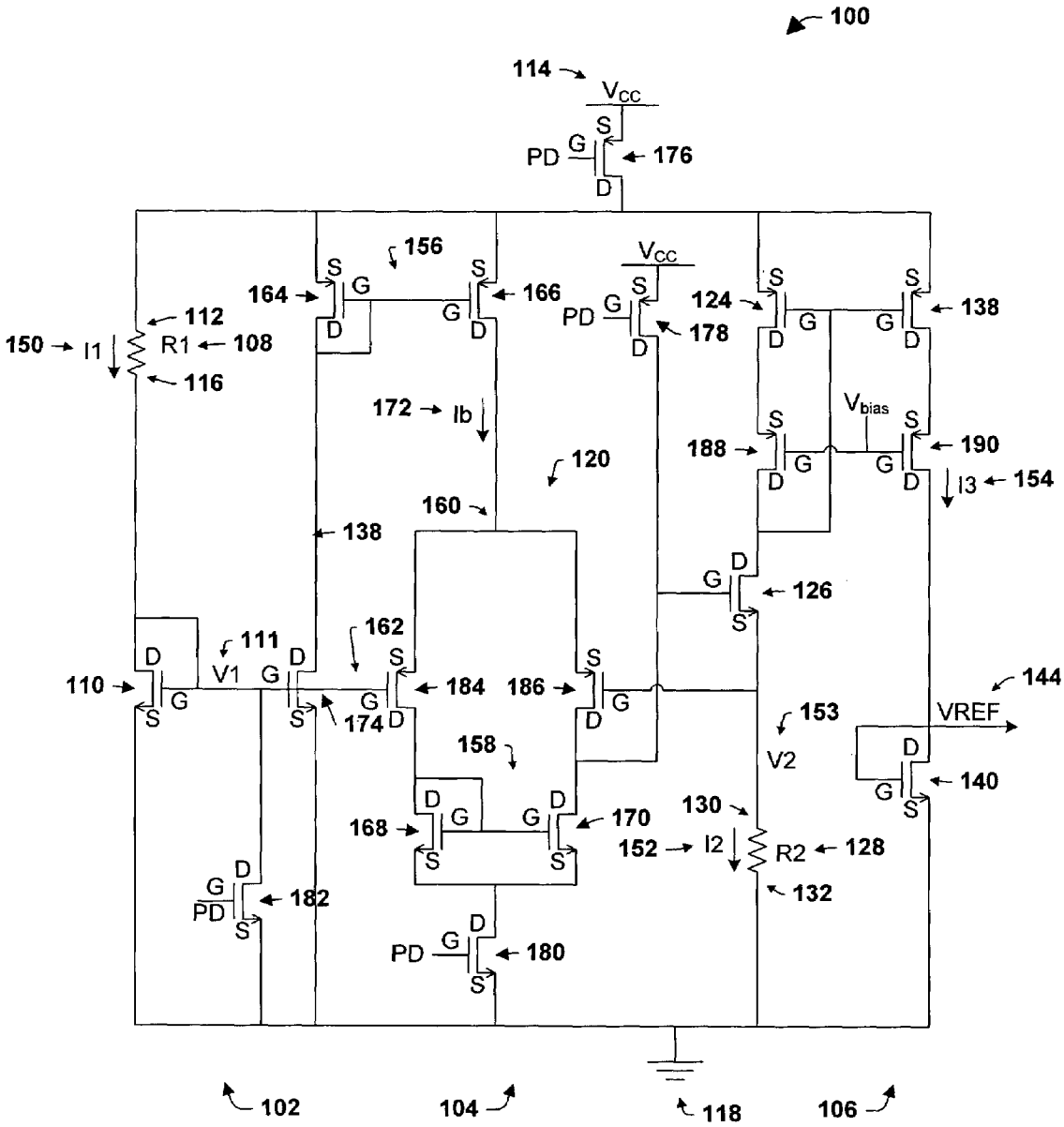
FIG. 2 is a schematic diagram illustrating the circuit arrangement of FIG. 1 in somewhat greater detail.

Turning to FIG. 2 a circuit schematic illustrates the exemplary circuit 100 of FIG. 1 in somewhat greater detail. Many of the components, elements, parts, etc. illustrated in FIG. 2 are similar to those in FIG. 1 and thus are addressed with the same reference characters. Since these similar components, elements, parts, etc. operate in a manner similar to their counterparts in FIG. 1, they are not discussed again with regard to FIG. 2 for purposes of brevity. In FIG. 2, the operational amplifier 120 is illustrated with two current mirrors 156, 158 and two inputs 160, 162. The upper current mirror 156 comprises a diode connected p device 164 and another p device 166. Similarly, the second current mirror 158 comprises a diode connected n device 168 and another n device 170. It can be appreciated that the upper current mirror 156 provides a bias current Ib 172 to the operational amplifier 120 at the first input 160. Similarly, an n type transistor device 174, which is driven by V1 111, is operatively associated with the op amp 120 at the second input 162.

In example illustrated in FIG. 2, a couple of power down p type transistors 176, 178 are coupled to the supply voltage Vcc 114, a couple of power down or bias n type transistors 180, 182 are coupled to ground 118, and the op amp 120 has two additional p type transistors 184, 186, where transistor 184 is situated at the second input 162 of the op amp 120.

The op amp 120 drives the n device 126 situated above resistor R2 128. The current mirror of the third stage 106 is illustrated as a cascode current mirror in the example presented in FIG. 2. In addition to p type devices 124, 138, this current mirror arrangement includes an additional pair of biasing p type transistors 188, 190 coupled to a bias voltage Vbias. The cascode configuration results in a higher impedance seen at the output node Vref 144. This allows the third stage current I3 154 to be even more invariant to fluctuations in Vcc 114.

Figure 3:
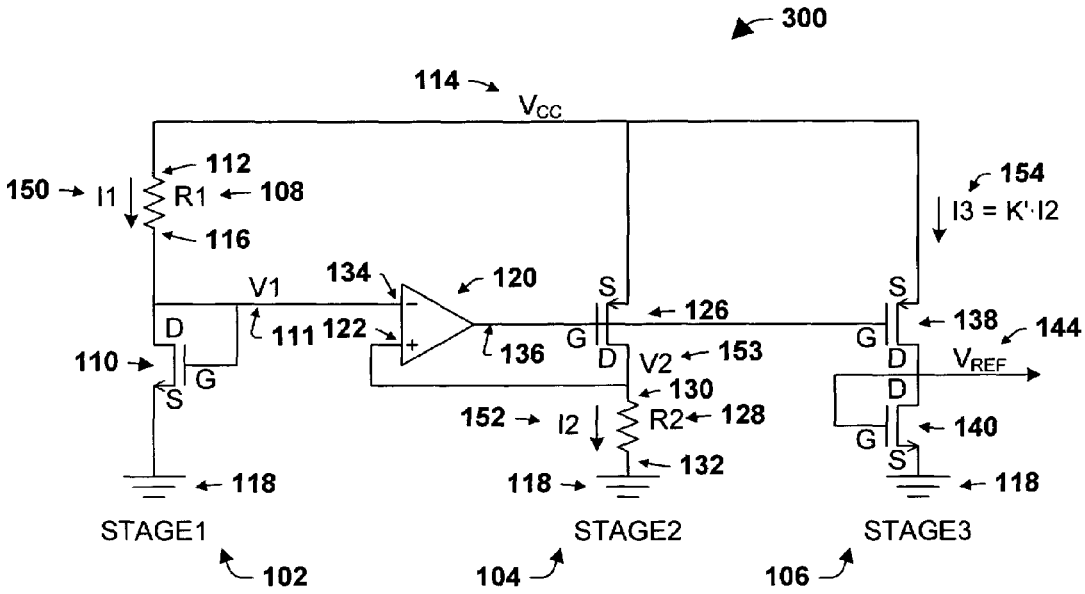
FIG. 3 is a schematic diagram illustrating another exemplary circuit arrangement according to one or more aspects of the present invention for quickly generating a wide range of temperature and Vcc insensitive voltage reference values.

FIG. 3 is a schematic diagram illustrating another exemplary circuit arrangement 300 according to one or more aspects of the present invention for quickly generating a wide range of temperature and Vcc insensitive voltage reference values. Many of the components, elements, parts, etc. illustrated in FIG. 3 are similar to those in FIG. 1 and thus are addressed with the same reference characters. These similar components, elements, parts, etc. are not, however, discussed again in FIG. 3 for purposes of brevity. In the circuit 300 in FIG. 3, V1 111 is applied to the negative input 134 of the op amp 120, rather of the positive input 122. This alternative configuration serves to reduce stage-2 and stage-3 complexity and enable operation at lower Vcc levels. Additionally, the circuit 300 lacks the current mirror arrangement of p type devices 124, 138 illustrated in FIG. 1. Instead, the output 136 of the op amp 120 drives the p type device 126 in the second stage 104 and the p type device 138 in the third stage 106. This induces the current I3 154 in the third stage, where I3 is equal to the second current I2 152 times a constant K', where K' corresponds a ratio of aspects of the n device 126 to the third device 138. The value of K' can be readily adjusted by varying the ratio of the devices 126 and 138 to one another. This allows the value of I3 154 to be controlled, which, in turn, allows the voltage reference values Vref 144 to be altered. Vref 144 could also be altered by varying the value of resistor R2 128.

Figure 4:
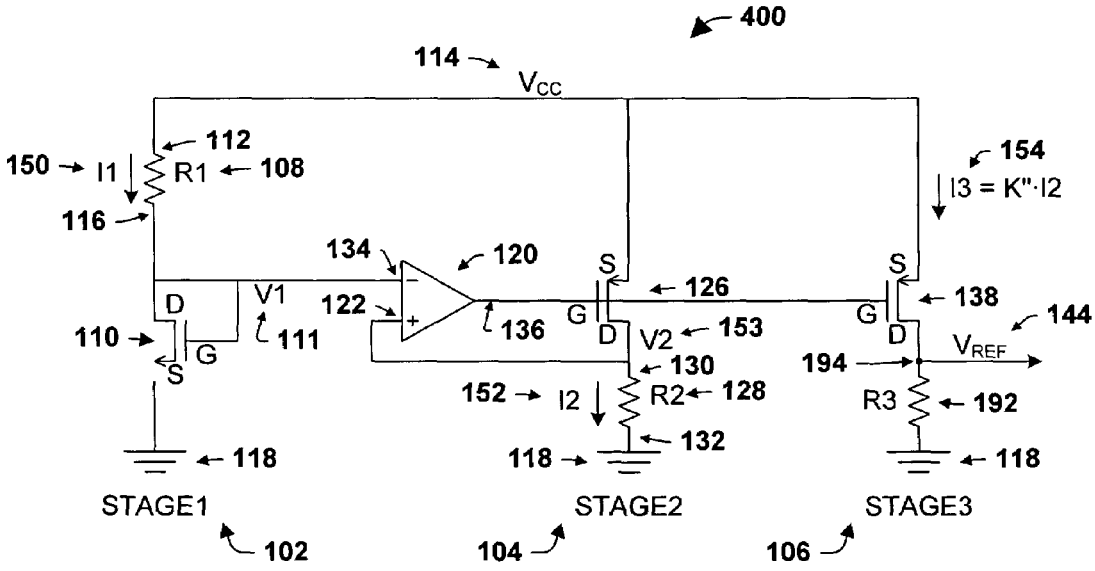
FIG. 4 is a schematic diagram illustrating yet another exemplary circuit arrangement according to one or more aspects of the present invention for quickly generating a wide range of temperature and Vcc insensitive voltage reference values.

FIG. 4 is a schematic diagram illustrating yet another exemplary circuit arrangement 400 according to one or more aspects of the present invention for quickly generating a wide range of temperature and Vcc insensitive voltage reference values. As with FIG. 3, components, elements, parts, etc. in FIG. 4 that are similar to those illustrated in FIG. 1 are addressed with the same reference characters, but are not discussed again for purposes of brevity. Like the arrangement 300 of FIG. 3, the arrangement 400 of FIG. 4 has V1 111 coupled to the negative input 134 of the op amp 120, and has the output 136 of the op amp 120 driving the p device 138 in the third stage. However, in the circuit 400, the n type device 140 is replaced with a resistor R3 192. The voltage references Vref 144 output by the circuit 400 are thus tapped off at a node 194 located just above the resistor R3 192. Again, the voltage reference values Vref 144 can be adjusted by altering the current I3 154, where I3 is equal to I2 152 times a constant K", where K" is a function of a ratio of aspects of transistors 126 and 138. In this configuration, the low-end of the Vref value is not limited by the device-Vt. It can thus be designed to be very close to the ground level. Accordingly, this circuit 400 has a larger Vref design range than the previous configurations. Additionally, since a square-law device (i.e., transistor 140) is replaced with a linear device (i.e., resistor R3 192), Vref shows the same (in)dependence on Vcc 114 as achieved by V1 in the first stage 102.

$$\Rightarrow \text{Vref} \propto \text{V1}$$

Accordingly, a circuit formed according to one or more aspects described herein can generate a wide range of temperature and Vcc insensitive voltage reference values relatively quickly. The circuit implements CMOS technology and employs a fast op amp-based feedback loop, rather than conventional bipolar technology based bandgap reference. Thus, the reference values come up fast and settle down very quickly (e.g., on the order of between about four and about nine nanoseconds) when the circuit is brought out of a power down stage. The circuit can generate voltage reference values from about the lowest threshold voltage Vt in the circuit to about Vcc for the configuration(s) presented in FIGS. 1, 2 and 3. The configuration presented in FIG. 4 can generate voltage reference values from rail-to-rail supply—albeit at the cost of lesser Vcc independence as illustrated above. The circuit is designed to compensate for variations in temperature, and so that the voltage reference values are held substantially constant regardless of fluctuations in the supply voltage Vcc. By way of example, the circuit can be used for reading memory cells, such as in manners set forth in U.S. patent application Ser. No. 11/087,944 entitled CURRENT SENSING CIRCUIT WITH A CURRENT-COMPENSATED DRAIN VOLTAGE REGULATION filed on Mar. 23, 2005, and U.S. patent application Ser. No. 11/023,914 entitled CURRENT SENSING ARCHITECTURE FOR HIGH BITLINE VOLTAGE, RAIL TO RAIL OUTPUT SWING AND Vcc NOISE CANCELLATION filed on Dec. 28, 2004, the entirety of both of which are hereby incorporated by reference herein.

Although the invention has been shown and described with respect to one or more implementations, equivalent alterations and modifications will occur to others skilled in the art based upon a reading and understanding of this specification and the annexed drawings. The invention includes all such modifications and alterations. With regard to the various functions performed by the above described components (assemblies, devices, circuits, etc.), the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary implementations of the invention. In addition, while a particular feature of the invention may have been disclosed with respect to only one of several implementations, such feature may be combined with one or more other features of the other implementations as may be desired and advantageous for any given or particular application. Furthermore, to the extent that the terms "includes", "having", "has", "with", or variants thereof are used in either the detailed description or the claims, such terms are intended to be inclusive in a manner similar to the term "comprising." Also, the term "exemplary" as utilized herein simply means an example, rather than the best.

What is claimed is:

1. A circuit for generating a voltage reference, comprising:

a first stage comprising;

a first resistor operatively coupled to a supply voltage Vcc, and a first transistor operatively coupled to the first resistor and to ground;

a second stage comprising;

an operational amplifier, a positive input terminal of which receives a first voltage V1 from the first stage, a second transistor driven by the operational amplifier, a second resistor, a first end of which is operatively coupled to the second transistor and back to a negative input terminal of the operational amplifier, and a second end of which is coupled to ground, and a third transistor operatively coupled to the second transistor and to the supply voltage, where a second voltage V2 is developed at the first end of the second resistor; and a third stage comprising;

a fourth transistor operatively coupled to the third transistor of the second stage so as to establish a current mirror arrangement such that a third current I3 developed in the third stage is a function of a second current I2 developed in the second stage, and a fifth transistor operatively coupled to the fourth transistor and to ground, which outputs one or more voltage reference values that are a function of the third current I3, the current mirror arrangement comprising a cascode current mirror arrangement to further mitigate sensitivity to fluctuations in the supply voltage, the cascode current mirror arrangement comprising;

a sixth transistor operatively coupled to the third transistor, and a seventh transistor operatively coupled to the fourth transistor as well as the sixth transistor; and a second current mirror arrangement for providing a bias current Ib to the operational amplifier.

2. A circuit for generating a voltage reference, comprising:

a first stage comprising;

a first resistor operatively coupled to a supply voltage Vcc, and a first transistor operatively coupled to the first transistor and to ground;

a second stage comprising;

an operational amplifier, a negative input terminal of which receives a first voltage V1 from the first stage, a second transistor operatively coupled to the supply voltage Vcc and driven by the operational amplifier, and a second resistor, a first end of which is operatively coupled to the second transistor and back to a positive input terminal of the operational amplifier, and a second end of which is coupled to ground, where a second voltage V2 is developed at the first end of the second resistor; and a third stage comprising;

a fourth transistor operatively coupled to the second transistor and to the supply voltage Vcc, and also driven by the operational amplifier, and a fifth transistor operatively coupled to the fourth transistor and to ground, the fifth transistor outputting one or more voltage reference values that are a function of a third current I3 developed in the third stage.

3. The circuit of claim 2, wherein at least one of;

the first transistor is a diode connected transistor, the first transistor is an n type transistor, the second transistor is a p type transistor, the fourth transistor is a p type transistor, and the fifth transistor is an n type transistor.

4. The circuit of claim 2, wherein at least one of;

the first resistor and the first transistor are tuned to mitigate sensitivity of the voltage reference values to fluctuations in the supply voltage Vcc, at least one of the first resistor, the first transistor and the second resistor are tuned to mitigate temperature sensitivity so that voltage reference values output by the circuit are substantially invariant to changes in temperature, the voltage reference values swing from about the lowest threshold voltage (Vt) in the circuit to about Vcc, and the circuit settles within a period of about four to about nine nanoseconds of applying Vcc.

5. A circuit for generating a voltage reference, comprising:

a first stage comprising;

a first resistor operatively coupled to a supply voltage Vcc, and a first transistor operatively coupled to the first resistor and to ground;

a second stage comprising;

an operational amplifier, a negative input terminal of which receiving a first voltage V1 from the first stage, a second transistor operatively coupled to the supply voltage Vcc and driven by the operational amplifier, and a second resistor, a first end of which is operatively coupled to the second transistor and back to a positive input terminal of the operational amplifier, and a second end of which is coupled to ground, where a second voltage V2 is developed at the first end of the second resistor; and a third stage comprising;

a fourth transistor operatively coupled to the second transistor and to the supply voltage Vcc, and also driven by the operational amplifier, and a third resistor, a first end of which is operatively coupled to the fourth transistor and a second end of which is operatively coupled to ground, one or more voltage reference values generated by the circuit being developed at the first end of the third resistor, the voltage reference values being a function of a third current I3 developed in the third stage.

6. The circuit of claim 5, wherein at least one of;

the first transistor is a diode connected transistor, the first transistor is an n type transistor, the second transistor is a p type transistor, and the fourth transistor is a p type transistor.

7. The circuit of claim 5, wherein at least one of;

the first resistor and the first transistor are tuned to mitigate sensitivity of the voltage reference values to fluctuations in the supply voltage Vcc, at least one of the first resistor, the first transistor and the second resistor are tuned to mitigate temperature sensitivity so that voltage reference values output by the circuit are substantially invariant to changes in temperature, the voltage reference values swing from about ground to about Vcc, and the circuit settles within a period of about four to about nine nanoseconds of applying Vcc.

8. The circuit of claim 5, wherein the third current is a function of a second current I2 developed in the second branch.

* * * * *